United States Patent [19]

Yoda et al.

[11] 4,104,861

[45] Aug. 8, 1978

[54] ELECTRONIC STOP WATCH

[75] Inventors: Kazuhiro Yoda; Michiaki Nakamura, both of Tokyo, Japan

[73] Assignee: Kabushiki Kaisha Daini Seikosha, Japan

[21] Appl. No.: 739,857

[22] Filed: Nov. 9, 1976

[30] Foreign Application Priority Data

Nov. 11, 1975 [JP] Japan ..... 50/135557

[51] Int. Cl.[2] ..... G04B 23/12; G04C 21/34; G04F 10/00

[52] U.S. Cl. ..... 58/38 R; 58/39.5; 58/57.5; 58/74; 58/152 B

[58] Field of Search ..... 58/18, 21.12, 38 R, 58/39.5, 57.5, 74, 152 B

[56] References Cited

U.S. PATENT DOCUMENTS 3,822,547 7/1974 Fujita ..... 58/152 B

*Primary Examiner*—Stanley J. Witkowski

*Attorney, Agent, or Firm*—Robert E. Burns; Emmanuel J. Lobato; Bruce L. Adams

[57] ABSTRACT

An electronic stopwatch including a time signal generator for generating a repetitive time signal, and a primary counting circuit for counting the time signal and for developing a count representing time in a timekeeping mode of operation. A secondary counting circuit receives the repetitive time signal during an interval to be measured, and develops a count representative of the length of the interval of time during which the time signal was applied thereto. The secondary counting circuit operates in a stopwatch mode of operation. A display selectively displays a time represented by the count of the primary counting circuit or the count of the secondary counting circuit in order to display either present time or a time interval measured in the stopwatch mode. An alarm is connected to receive the repetitive time signal applied to the secondary counting circuit and generates an alarm signal after the repetitive time signal has been applied thereto for a predetermined period of time. Therefore, in the stop watch mode an audible alarm indicates when an interval of time of a predetermined length has occurred and does not require a user of the stopwatch to visually watch the display in order to know when that predetermined interval of time has elapsed.

7 Claims, 4 Drawing Figures

ELECTRONIC STOP WATCH

BACKGROUND OF THE INVENTION

This invention relates to an electronic stopwatch, and more particularly to one which indicates elapse of a predetermined interval of time by the sounding of an alarm signal which can be selectively developed during the operation of the stop watch.

In the conventional mechanical or electronic stopwatch, the elapsed time indicated by a watch operation of the hand or an alpha-numeric display.

However, in the above noted construction, the time indication is visual whereby it is not possible to measure a continuously advancing interval of time without continuously or intermittently watching the timepiece. To eliminate this difficulty, structure for measuring lap time has been employed, however, it is still very difficult to check elapsing time together with watching the play of an event.

SUMMARY OF THE INVENTION

An object of the present invention is to provide means for indicating the elapsing of time by sounding an alarm intermittently during the operation of a timepiece as a stopwatch.

DESCRIPTION OF THE PREFERRED EMBODIMENT

Figure 1:
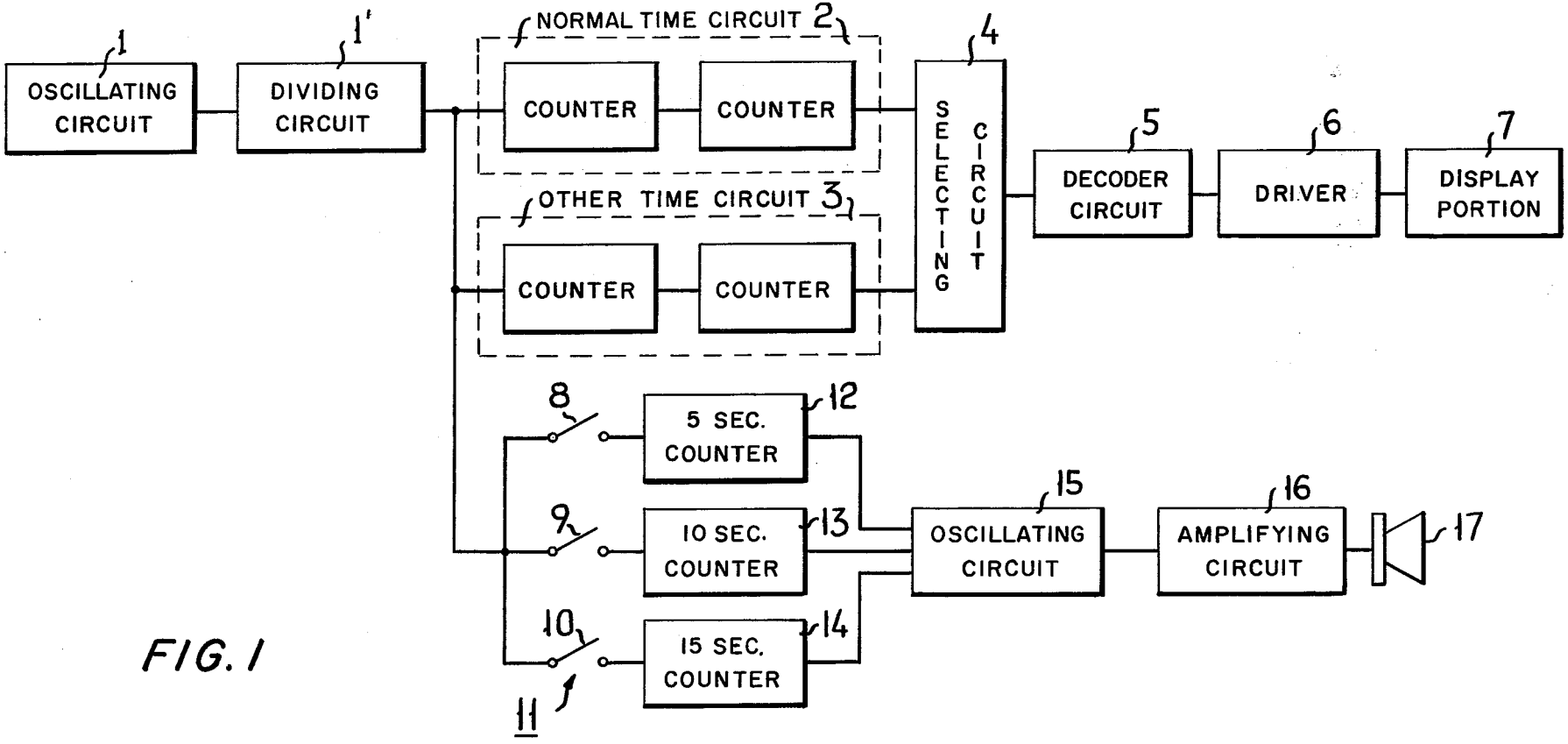
FIG. 1 shows the circuit block of an electronic alarm stopwatch according to the present invention.

FIG. 1 shows one embodiment of the electronic stopwatch according to the present invention, wherein a 1 second signal generated from an oscillator 1 and dividing circuit 1' is applied to a normal time circuit 2 and on other time circuit 3 which operates in a stopwatch made. The output signals of said normal time circuit 2 and other time circuit 3 are applied to a display portion 7 after being applied to a decoder circuit 5 and driver 6 via a selecting circuit 4.

Further, the 1 second signal generated from said oscillating dividing circuit 1 is selectively applied to the first, second and third counters 12, 13 and 14 via the switch group 11 composed of the first, second and third switches 8, 9 and 10, and the output signals of said counters 12, 13 and 14 are applied to an oscillating circuit 15.

The signal from an oscillating circuit 15 is connected to an alarm member 17 via an amplifying cirucit 16.

The time contents or count representative of time of said normal time circuit 2 is applied to said display portion 7 via said selecting circuit 4, decoder 5 and driver 6 when said selecting cirucit 4 is maintained in the normal time display condition.

Further, the time contents of said other time circuit 3 is applied to said display portion 7 via said selecting circuit 4, decoder 5 and driver 6, and the 1 second signal from said oscillator 1 dividing circuit 1' is applied to the 5 seconds counter or first counter 12 when said first switch 8 is set to the ON-position. The oscillating circuit 15 is operated by the output signal of said counter 12 whenever 5 seconds have elapsed, whereby said output signal of said oscillating circuit 15 is able to operate said alarm member 17 via said amplifying circuit 16.

Said counters 12, 13 and 14 are respectively constructed as 5 seconds, 10 seconds and 15 seconds counters, whereby said alarm member is selectively operated after a period of 5 seconds, 10 seconds and 15 seconds. However, it is possible to set the term to 1 second, 2 seconds and 3 seconds or some other combination of count periods.

According to the present invention, in case of using the timepiece as as a stopwatch, it is possible to acknowledge the elapsing time by the sound of the alarm 17 being operated after every certain time interval whereby it is possible to determine the elapsing time by the sense of vision and the sense of hearing.

Figure 2:
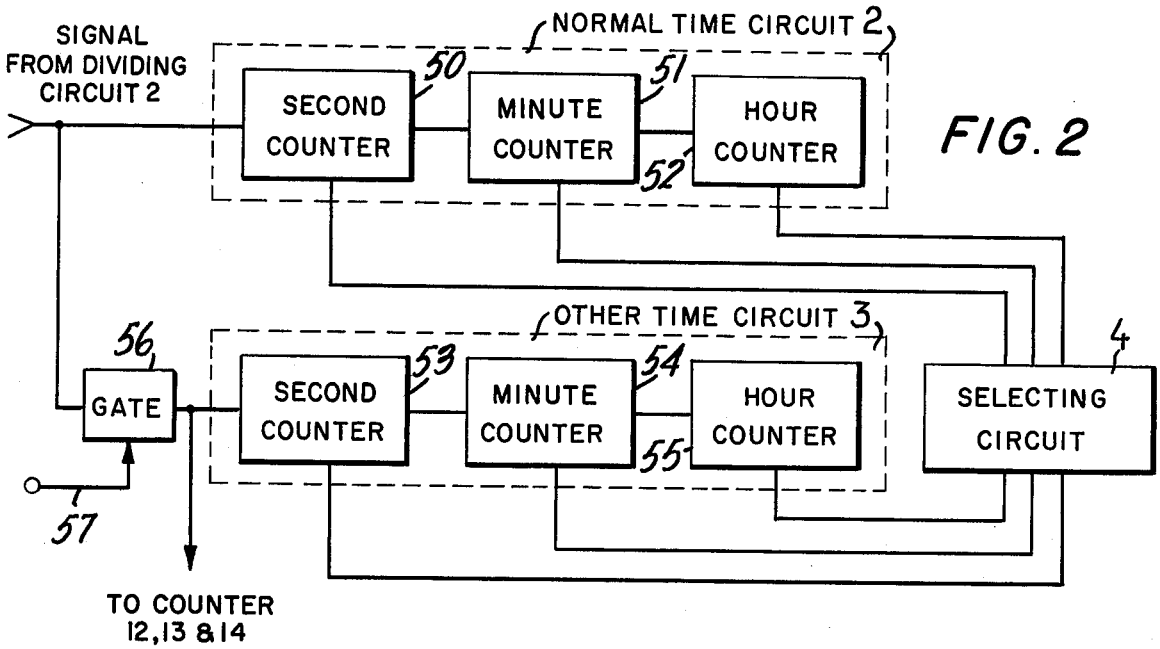
FIG. 2 illustrates the structure of the time circuits represented in FIG. 1.
Figure 4:
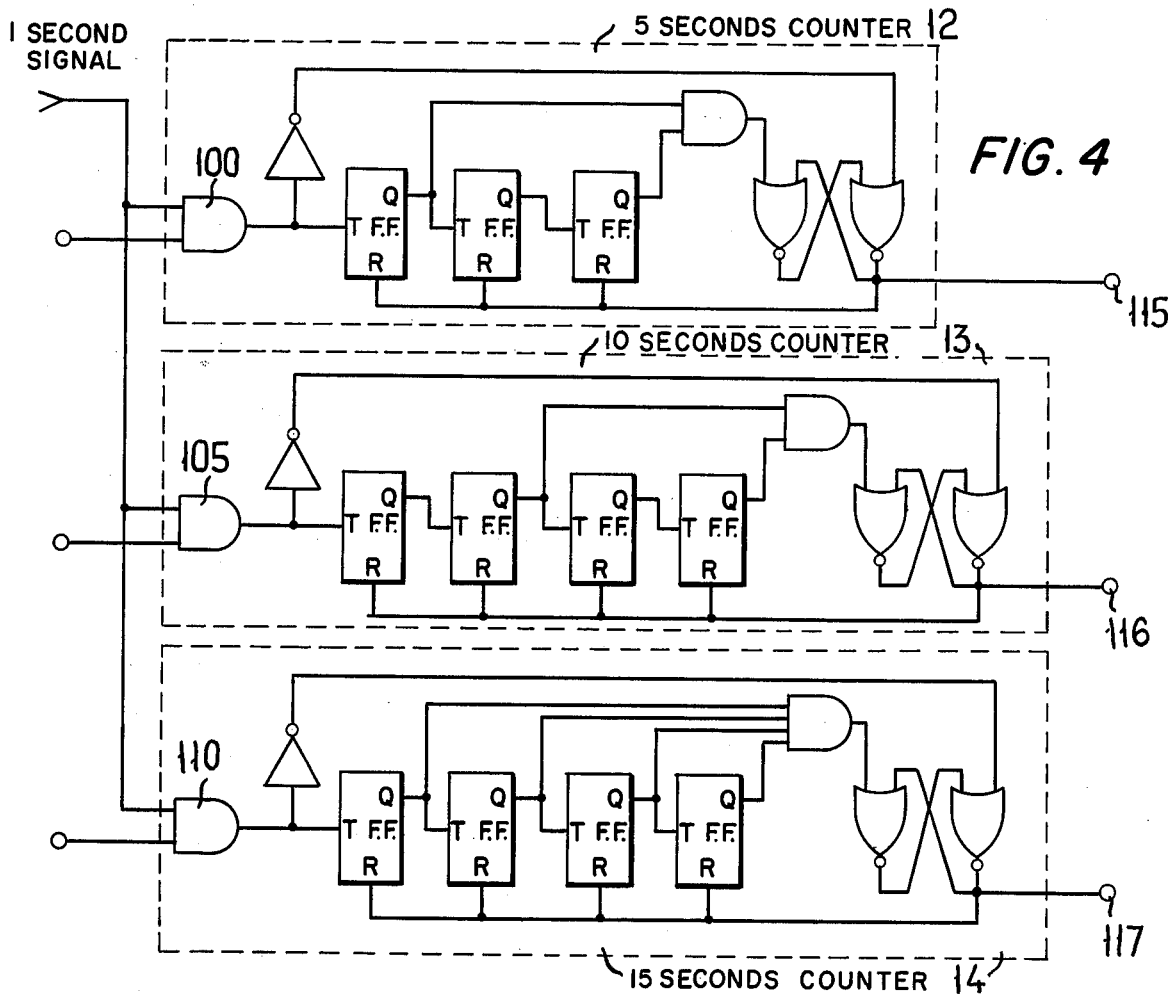
FIG. 4 is a schematic circuit diagram of the counter circuits illustrated in FIG. 3.
Figure 3:
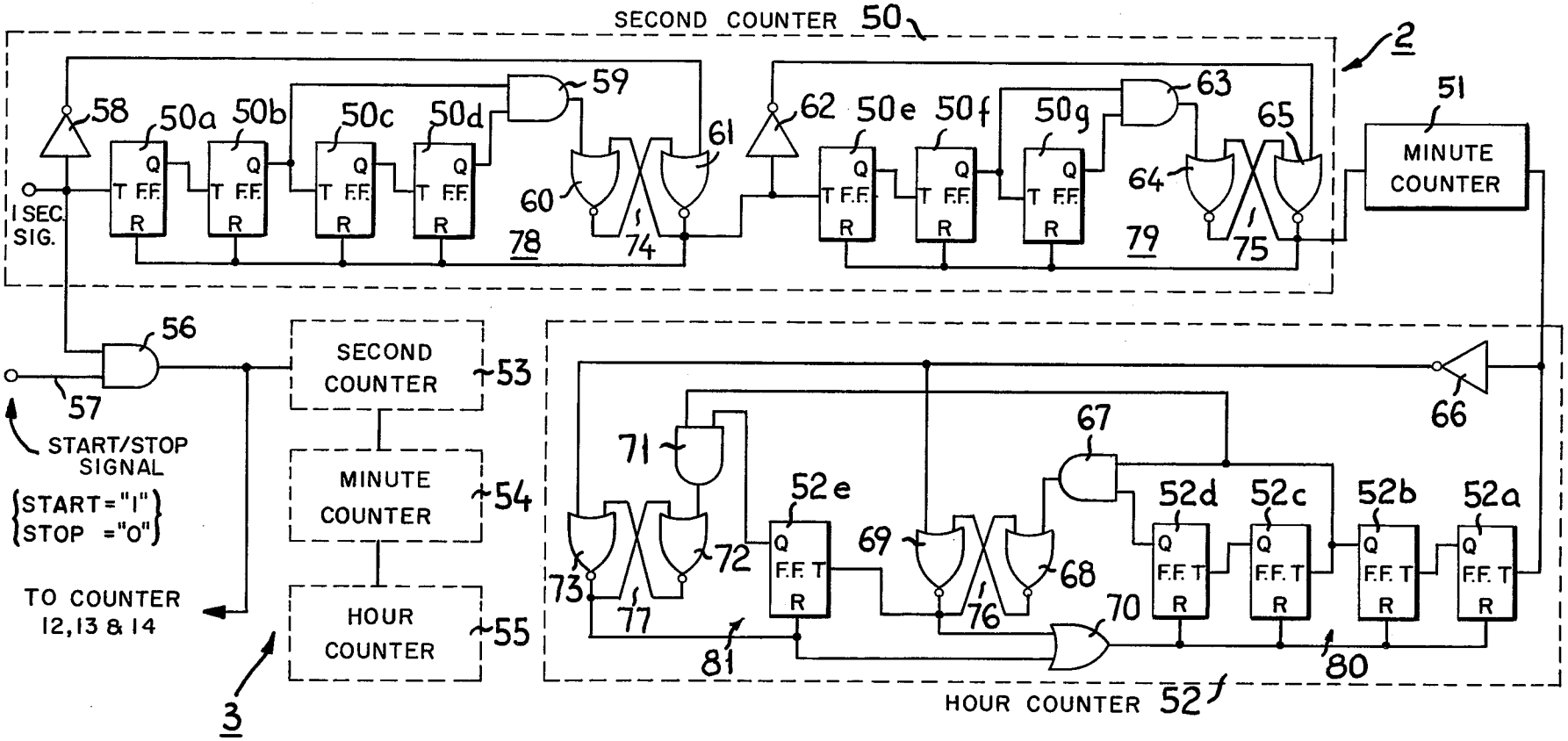
FIG. 3 illustrates the structure of the counter circuits shown in FIG. 2.

Referring now to the embodiment of FIG. 1 illustrated in more detail in the accompanying drawings in FIG. 2, FIG. 3 and FIG. 4:

The normal time circuit 2 is comprised of the second counter 50, minute counter 51 and hour counter 52, and the other time circuit 3 is comprised of the second counter 53, minute counter 54 and hour counter 55. The normal time counter 2 and the other time counter 3 are connected by the AND-gate 56, and the output signal of the AND-gate 56 is connected to the counters 12, 13 and 14.

The second counter 50 is comprised of the 1 second counter 78 and the 10 seconds counter 79. The 1 second counter 78 is comprised of the set reset flip flop 74 (referred as RS-FF), the T-flip flop (referred as T-FF), chain 50*a*, 50*b*, 50*c* and 50*d*, the inverter 58, AND-gate 59, and NOR-gates 60 and 61. The 10 seconds counter 79 is comprised of the RS-FF 75, the T-FF 50*e*, 50*f*, and 50*g*, the inverter 62, AND-gate 63 and NOR-gates 64 and 65. The minute counter 51 is identical to the second counter 50, therefore the detailed description and the circuit construction is omitted. The hour counter 52 is comprised of the 1 hour counter 80 and the 10 hour counter 81. The 1 hour counter 80 is comprised of the OR-gate 70 and RS-FF 76, T-FF 52*a*, 52*b*, 52*c*, 52*d*, the inverter 66, the AND-gate 67 and the NOR-gates 68 and 69. Further the 10 hour counter 81 is comprised of the RS-FF 77, T-FF 52*e*, AND-gate 71 and NOR-gates 72 and 73.

The signal from the 1 second signal is applied to the one input terminal of the AND-gate 56, and the START/STOP signal is applied to the other input terminal of the AND-gate 56. The output of the AND-gate 56 is applied to the counter 53 and is further applied to the counters 11, 12 and 13. The construction of the second counter 53 is identical to the second counter 50, and the minute counter 54 and hour counter 55 are identical to the minute and hour counters 51 and 52. The second counter 50 counts the 1 second signal, and generates and applies the 1 minute signal to the minute 51 after counting 60 seconds. The minute counter 51 counts the 1 minute signal, and applies the 1 hour signal to the hour counter 52 after counting 60 minutes.

Referring now to the operation as the stop watch:

When the start signal "1" is applied to the AND-gate 56 via the input terminal 57, the AND-gate 56 is changed to the ON-condition, and the 1 second signal is applied to the second counter 53, minute counter 54 and hour counter 55.

When the signal of the input terminal 57 is changed to "0", the AND-gate 56 is changed to the OFF-condition, whereby the one second signal is not applied to the second counter 53. Namely, the period during which the start/stop signal is maintained "1" is measured.

FIG. 4 shows the 5, 10 and 15 seconds counters 12, 13 and 14. When the 5 seconds counter 12 was selected, only AND-gate 100 of the 5 seconds counter 12 becomes ON, the other AND-gates 105 and 110 of the counters 13 and 14 remain in the OFF-state. Therefore, the 1 second signal passing through the AND-gate 56 is applied to the counter 12 only. The counter 12 operates in a f5-counting mode, whereby the pulse is generated and applied to the output terminal 115 connected to the oscillating circuit 15 after 5 seconds have elapsed.

In the same way, when the 10 seconds counter 13 is selected, only AND-gate 105 of the 10 seconds counter 13 becomes ON, and, the 1 second signal of passing the AND-gate 56 is applied to the counter 13 only. The counter 13 operates in a 10-counting mode, whereby the pulse is generated and applied to an output terminal 116 connected to the oscillating circuit 15 after 10 seconds elapsed.

The seconds counter 15 is operated by the same circuit operation as the counters 12 and 13 via AND-gate 110 and the output terminal 117.

We claim:

1. An electronic stopwatch comprising:

time signal generating means for generating a repetitive time signal having a repetition rate defining an interval of time;

a primary counting circuit responsive to said repetitive time signal and connected to receive said repetitive time signal for counting the same and for developing a progressively increasing count representing advance of time in response to said repetitive time signal and providing a timekeeping mode of operation;

a secondary counting circuit responsive to said repetitive time signal for counting the same and for developing a progressively increasing count representing advance of time in response to said repetitive time signal;

means for applying and for terminating application of said repetitive time signal to said secondary counting circuit to enable said secondary counting circuit to develop a count representative of the time interval during which said repetitive time signal is applied to said secondary counting means for operating in a stopwatch mode;

display means cooperative with said counting circuits for selectively displaying a time represented by the count of a respective one of said counting circuits; and alarm means connected to receive the repetitive time signal applied to said secondary counting circuit by said means for applying for generating an alarm signal after the repetitive time signal has been applied to said alarm means for a predetermined period of time.

2. An electronic stopwatch according to claim 1, wherein said primary counting circuit and said secondary counting circuit each comprise a respective second counter, minute counter and hour counter connected in cascade for developing counts respectively representing seconds, minutes and hours; and wherein said display means is comprises of a display, a decoder and a driver circuit responsive to the counts of said counters for enabling said display to display a time represented by said counts, and a selecting circuit operative for connecting said decoder and driver circuit to a selected one of said primary and secondary counting circuits for selectively displaying a time developed in the timekeeping mode and a time interval measured in the stopwatch mode.

3. An electronic stopwatch according to claim 1, wherein said means for applying and for terminating application of said repetitive time signal is comprised of a two-input AND gate having an output terminal connected for applying an output signal of said AND gate to said secondary counting circuit and said alarm means, a first input terminal connected to receive said repetitive time signal, and second input for receiving a start/stop signal for enabling said AND gate to develop said repetitive time signal as the output signal of said AND gate and to apply the same to said secondary counting circuit and said alarm means as long as said start/stop signal is applied to said AND gate.

4. An electronic stopwatch according to claim 1, wherein said alarm means is comprised of at least one counter responsive to said repetitive time signal for developing a counter output signal after said repetitive time signal is applied to said at least one counter for a certain predetermined interval of time, means for applying the repetitive time signal applied to said secondary counting circuit to said at least one counter, and an alarm circuit responsive to and connected to receive the counter output signal for emitting an alarm signal when said predetermined interval of time has elapsed.

5. An electronic stopwatch according to claim 4, wherein said means for applying the repetitive time signal to said at least one counter includes a manually operable switch to allow a user of the timepiece to control whether the repetitive time signal is applied to said at least one counter.

6. An electronic stopwatch according to claim 4, wherein said alarm circuit is comprised of an oscillator responsive to and connected to receive the counter output signal for developing an oscillatory output signal in response thereto, an alarm enabled by said oscillatory output signal for emitting an audible alarm signal for alerting a user of the timepiece, and means for applying said oscillatory output signal to said alarm.

7. An electronic stopwatch according to claim 4, comprising a plurality of counters each responsive to said repetitive time signal each for developing a respective counter output signal after said repetitive time signal is applied thereto for a respective predetermined interval of time, and wherein said means for applying the repetitive time signal includes a plurality of manually operable switches to allow a user of the timepiece to control whether the repetitive time signal is applied to a respective one of said counters for determining the length of the time interval before said alarm signal is emitted.

* * * * *